US006339052B1

(12) United States Patent
Dohhen et al.

(10) Patent No.: US 6,339,052 B1
(45) Date of Patent: Jan. 15, 2002

(54) LUBRICANT COMPOSITIONS FOR INTERNAL COMBUSTION ENGINES

(75) Inventors: Khem Chand Dohhen; Krishan Kumar Swami; Pankaj Kumar Mondal, all of Haryana; Shanti Parkash, Gurgaon; Rakesh Sarin; Deepak Kumar Tuli, both of Faridabad; Akhilesh Kumar Bhatnagar, Faridabad, all of (IN)

(73) Assignee: Indian Oil Corporation Limited, Mumbai (IN)

( * ) Notice: Subject to any disclaimer, the term of this patent is extended or adjusted under 35 U.S.C. 154(b) by 0 days.

(21) Appl. No.: 09/609,308

(22) Filed: Jun. 30, 2000

(51) Int. Cl.[7] ..... C10M 137/08; C10M 159/22
(52) U.S. Cl. ..... 508/436; 508/574
(58) Field of Search ..... 508/436, 574

(56) References Cited

U.S. PATENT DOCUMENTS

| | | | | |
|---|---|---|---|---|
| 2,370,302 A | | 2/1945 | Ghez et al. | 36/33 |
| 3,367,867 A | | 2/1968 | Abbott et al. | 508/392 |
| 4,089,791 A | | 5/1978 | Haugen et al. | 508/373 |
| 4,098,765 A | * | 7/1978 | Kays et al. | 528/1 |
| 4,147,640 A | | 4/1979 | Jayne et al. | 508/324 |
| 4,330,420 A | | 5/1982 | White et al. | 508/174 |
| 4,639,324 A | | 1/1987 | Lam | 508/343 |
| 4,874,007 A | | 10/1989 | Taylor | 137/312 |
| 5,639,804 A | * | 6/1997 | Yesnik | 523/156 |
| 5,910,468 A | | 6/1999 | Dohhen et al. | 508/332 |
| 5,916,850 A | | 6/1999 | Tuli et al. | 508/353 |

FOREIGN PATENT DOCUMENTS

EP 0 915 097 A1 5/1999

* cited by examiner

*Primary Examiner*—Ellen M. McAvoy
(74) *Attorney, Agent, or Firm*—Venable; Ashley J. Wells

(57) ABSTRACT

A lubricating oil composition for gasoline and diesel internal combustion engines includes a major portion of an oil of lubricating viscosity; from 0.1 to 20.0% w/w of a component A which is a sulfurized, overbased calcium phenate detergent derived from distilled, hydrogenated cashew nut shell liquid; and from 0.1 to 10.0% w/w of a component B which is an amine salt of phosphorodithioic acid derived from cashew nut shell liquid and has a general formula as follows:

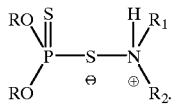

12 Claims, No Drawings

LUBRICANT COMPOSITIONS FOR INTERNAL COMBUSTION ENGINES

BACKGROUND OF THE INVENTION

1. Field of the Invention

This invention relates to lubricating oil compositions which exhibit marked improvement in the detergency characteristics resulting in lower engine carbon deposits and makes available an internal combustion engine oil package, both for gasoline and diesel engines, with substantial improvement in the biodegradability. More particularly, this invention is directed to lubricating oil compositions for internal combustion engines which contain a synergistic mixture of calcium phenate overbased detergent which is derived from cashew nut shell liquid (CNSL) and an amine salt of phosphorodithioic acid derived from CNSL.

2. Background of the Related Art

Lubricant additives can be classified as materials that impart new properties to or enhance existing properties of the lubricant into which these are incorporated. The lubricant additives, besides showing enhanced performance, need to be cost-effective, easily manufactured and should have higher biodegradability.

Detergents, anti-wear and antioxidants constitute a major class of lubricant additives, which find application in engine lubricants especially for internal combustion gasoline and diesel engines. Among the conventionally used detergents in lubricating oil additives are metallic sulfonates, phenates and salicylates. Metallic phenates and sulfurized metal phenates are one of the widely used detergents in lubricating oils, for mainly internal combustion gasoline and diesel engines, and these function to neutralize acid substances, sludge etc., generated in an engine. Thus, the metallic phenates, generally alkaline earth metal phenates, provide engine parts with good protection from excessive corroding caused by acidic substances and prevent excessive wear caused by sludge. The overbasing of these phenates helps in fighting the acids produced during the combustion of fuel, while the sulfurization mainly helps to improve heat stability.

The conventional method of making overbased metallic sulfurized phenates, useful as lubricating oil additives, involves reacting alkyl substituted phenols, generally para-substituted, with sulfur, metal salts followed by carbonation. Thus, U.S. Pat. No. 2,370,302 discloses the use of sulfurized phenates in lubricating compositions which are subjected to higher temperatures. Similarly, U.S. Pat. No. 3,367,867 discloses the use of sulfurized overbased calcium phenates as detergents in lubricating oils for internal combustion engines. U.S. Pat. No. 4,874,007 discloses a process for preparation of sulfurized alkyl-substituted phenates to be used as detergents. In U.S. Pat. No. 5,910,468, we have already described a process for the preparation of calcium phenate detergents derived from naturally occurring and biodegradable cashew nut shell liquid. It was surprisingly discovered that overbased calcium phenates derived from cashew nut shell liquid had low viscosity at high basicity, good oil solubility and higher biodegradability. These phenates could be prepared in an economically advantageous manner and showed remarkably good detergency.

The anti-wear protection and protection against oxidation at high temperature to a lubricating oil used in internal combustion engines is generally met by addition of metallic dialkyldithiophosphates. However, these metallic dithiophosphates contribute to the total ash content of the lubricant composition. Since the zinc is a source of sulfated ash and phosphorus is a poison for catalytic converters, the art has sought to reduce both Zn and P from the lubricating oil compositions (see U.S. Pat. Nos. 4,147,640; 4,330,420; and 4,639,324). While the prior art has been successful in reducing the zinc additive, giving a low ash lubricant formulation, the total removal of zinc has not been recommended as a practical proposition. U.S. Pat. No. 4,330,420 discloses the inclusion of synergistic amounts of dialkyldiphenyl amine antioxidant and sulfurized polyolefins to bring down the amount of zinc dithiophosphate. U.S. Pat. No. 4,089,791 relates to a low ash mineral lubricating oil composition comprising zinc dialkyldithiophosphate, overbased alkaline earth metal salts and a trialkanolamine compound as an additional anti-oxidant component to compensate for the reduced ZDDP. In U.S. Pat. No. 5,916,850 and EP Pat. No. 0915097A1, we have disclosed a process for the preparation of various amine salts of phosphorodithioic acids, derived from cashew nut shell liquid, which, when blended into lubricants, provide effective anti-wear, anti-oxidant and friction reducing properties. Inclusion of these ashless dialkyldithiophosphates into the lubricant formulations for internal combustion gasoline and diesel engines, has resulted in reduction of ash content. These dialkyldithiophosphates, surprisingly, have shown a synergistic boost to the detergency action of CNSL derived sulfurized metallic phenate additives.

An object of this invention is to propose a synergistic composition of lubricating oil for internal combustion gasoline and diesel engines, which exhibit higher detergency and lower ash content. Another object of this invention is to disclose synergistic lubricating oil compositions for internal combustion engines containing sulfurized overbased calcium phenates derived from cashew nut shell liquid and multifunctional additive based on amine salts of phosphorodithioic acids derived from cashew nut shell liquid resulting in higher oxidation stability, higher detergency, lower zinc and phosphorus content and higher biodegradability.

SUMMARY OF THE INVENTION

A lubricating oil composition for gasoline and diesel internal combustion engines includes a major portion of an oil of lubricating viscosity; from 0.1 to 20.0% w/w of a component A which is a sulfurized, overbased calcium phenate detergent derived from distilled, hydrogenated cashew nut shell liquid; and from 0.1 to 10.0% w/w of a component B which is an amine salt of phosphorodithioic acid derived from cashew nut shell liquid and has a general formula as follows:

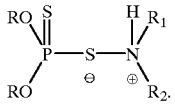

DESCRIPTION OF THE PREFERRED EMBODIMENTS

Component A

Overbased metallic sulfurized phenate detergent useful in this invention comprise a substance prepared by reacting distilled or hydrogenated distilled CNSL, with calcium hydroxide or oxide, and sulfur, in the presence of co-surfactants and mineral oil, and carbonation of the resulting reaction mixture.

In preparation of the overbased sulfurized overbased calcium phenates of the present invention, CNSL, a naturally occurring biodegradable, cheap and abundantly available material is used. The overbased detergent component of the present invention is easily and conveniently produced by a simple sequential reaction with sulfur, calcium oxide/hydroxide, followed by a step of overbasing with carbon dioxide, in the presence of cosurfactants. If required, the resulting basic sulfurized metal phenate can be subjected to further overbasification. By selecting various reaction conditions and processing steps it is possible to obtain overbased calcium phenate detergents derived from CNSL, fully soluble in lubricating oil base stocks, having the TBN in the range of 100–400 mg KOH/g. The amount of component A in lubricant compositions of the present invention, for internal combustion gasoline and diesel engines, may range from 0.5 to 20% by weight of the total lubricant composition. However, the preferred range for lubricating oil meeting API SC/CC to SG/CD classification is 0.5 to 12 wt%.

Component B

Component B of the compositions of this invention is an anti-wear and anti-oxidant agent comprised of amine salts of phosphorodithioic acids derived from CNSL. The general procedure for synthesis of these additives consists of reaction of distilled CNSL or distilled hydrogenated CNSL with phosphorus pentasulfide and the neutralization of resulting phosphorodithioic acids with suitable amines. The amount of this component in lubricant composition of the present invention, for internal combustion gasoline and diesel engines may range from 0.1 to 10% by weight of the total lubricant composition. Preferred range of this additive for making lubricating oil meeting API SC/CC to SG/CD grade of lubricating oils is 0.5 to 6 weight %.

Biodegradability Test

The biodegradability tests of components A and B were carried out in comparison to the commercial additives, according to CEC-L-33-A-93 protocol. In the test procedure, flasks containing mineral media with test sample and innoculum from the sewage plant are incubated for 21 days. At the end of the test, these flasks are extracted with organic solvent and analyzed by IR measurements. The biodegradability is expressed as a percentage difference between test and poisoned flask. The detergent component A of the present invention shows about 20% more biodegradability than the commercial phenates, while the enhancement in biodegradability for component B was more than 100% vis-à-vis commercial ZDDP. The biodegradability data is shown in Table-1.

TABLE 1

Biodegradability Test Results on Component A and B per CEC-L-33-A-93 Protocol

| S.NO. | Additive Component | % Biodegradability |
|---|---|---|
| 1. | Component A | 41.27 |
| 2. | Commercial Phenate 1 | 32.10 |
| 3. | Commercial Phenate 2 | 32.49 |
| 4. | Component B | 21.86 |
| 5. | Commercial ZDDP | 10.36 |

Other components used in the lubricating compositions of the present invention are (i) a dispersant, polyisobutylene succinimide type, commercially available from Lubrizol (LZ 890) or Infenium [SAP 210 and 240) or Ethyl [Hitec 644 or 646] or Chevron [Oloa 1200 and 3740]. These commercially available dispersants were used in the range of 2–12% in the lubricating compositions of the present invention; (ii) antioxidants, mixture of phenolic and aminic antioxidants; commercially available additives include (Ethyl E-702) & (Irganox L-57); and (iii) anti-wear additives of the ZDDP type available from Lubrizol, LZ1395 or LZ 1360 or Hitec 678 or LZ 677. Commercially available viscosity index improvers viz. ECA 8586, Paratone 8523 or TLA 3471 can be added to these base stocks as needed to obtain the lubricating oil of desired viscosity grade.

The lubricating oil base stock used for preparing the composition of the present invention include both mineral and synthetic hydrocarbon, oils of lubricating viscosity. The mineral lubricating oils may be paraffinic, naphthenic or asphaltic base, or mixtures thereof. Typical synthetic oils which could be used to prepare the lubricating compositions of the present invention include trimethylolpropane esters, neopentyl and pentaerythritol esters, polyethylene glycol, bis(2-ethylhexyl)adipate, bis(2-ethylhexyl)sabicate, polyalphaolefins and phenoxyphenyl ethers.

The lubricating oil composition with the synergistic combination of detergent (A) and aminothiophosphate component (B), as disclosed in the present invention, results in premium grade lubricating oils for internal combustion engines and show excellent heat stability, detergency and compatibility with other additive components. Moreover, these components are highly economical, since the basic raw materials of components A and B consist of naturally occurring, biodegradable, abundantly available and cheap cashew nut shell liquid (CNSL).

Lubricating oil compositions for internal combustion gasoline and diesel engine oils of various performance grades, disclosed herein and which incorporate CNSL derived detergent and anti-wear/anti-oxidant additives have neither been suggested or taught in the prior art. Thus, this constitutes the first ever report, teaching lubricating oil compositions for gasoline and diesel internal combustion engines, using naturally, biodegradable, raw material, CNSL.

The novel lubricating oil compositions for internal combustion engine oils disclosed herein are expected to provide exceptional benefits in terms of lower costs, superior performance, lower ash content, ease of preparation and higher biodegradability.

The examples of the compositions of the present invention, as given in Tables 2 and 3, are illustrative in nature, but without intending to imply any limitations thereon.

The efficacy of the compositions of this invention has been thoroughly evaluated by laboratory, rig and engine tests.

Detergency Performance—Panel Coker Test

The detergency efficacy of crankcase oils of the present invention was assessed in terms of deposit forming tendency on rectangular Al-steel panel in a Panel Coker test. In this test, 200 ml of the test sample is taken in sump and heated at 100° C. For a period of 6 hrs, this heated oil is splashed by whiskers on an Al-steel Panel, the temperature of which is maintained at 300° C. After completion of the test, any deposits on the panel are weighed. The base fluid without any detergent additive showed an increase in panel weight of 238.5 mg. Incorporation of overbased sulfurized calcium phenates, derived from cashew nut shell liquid of the present invention, decreased the deposit the panel from 238.5 mg to 25–35 mg, as compared to deposit of 45–70 mg, when conventional calcium over based sulfurized phenate detergent were used at the equivalent concentrations. This clearly demonstrates superior detergency action of the product of the present invention. The compositions, their physico-chemical characterization and their performance in the Panel Coker test are presented in Tables 2 to 5.

Antioxidant Performance—Pressure Differential Scanning Calorimetry (PDSC)

The PDSC (DuPont Model-910/1090B) was used for relative antioxidant performance evaluation of the composition. In this method, a test sample (10 mg) taken in a sample boat was subjected to heating from 100–300° C. at the rate of 10° C. per minute under 500 psi oxygen pressure. The onset of oxidation temperature was adopted as a criteria for assessment of antioxidant performance. In general, an increase in onset of oxidation temperature indicates improvement in antioxidant performance. The incorporation of aminophosphorodithioates derived from CNSL, at 0.5–1.0% level, increased the temperature of the onset of oxidation by 30–85° C., w.r.t. unformulated base oil. The addition of 1–2% of overbased sulfurized calcium CNSL phenate detergent of the present invention, to the lubricating oil base stock also enhanced the onset of oxidation temperature by 25–65° C., which is indicative of better antioxidant characteristics of the product.

Surprisingly, the combination of sulfurized calcium CNSL phenate of the present invention and aminophosphorodithioates derived from CNSL proved to be synergistic in improving the antioxidant performance of the lubricant composition. The combination of both CNSL derived components increased the onset of oxidation temperature by 65–105° C. This synergistic composition was incorporated to formulate the engine oil composition, by incorporating other conventional lubricating oil additives, i.e., metallic sulfonates, polymeric succinimides, polymeric viscosity index improvers, pour point depressants, corrosion inhibitors and the like. The compositions, their physio-chemical characterization and their performance in the DSC test are presented in Tables 2 to 5.

Hot Oil Oxidation Test

The hot oil oxidation test (HOOT) is a laboratory oxidation test in which air is bubbled at 10 liters/hour for 64 hours in the test lubricant at 160° C. in the presence of copper & ferrous naphthenates as catalysts. After the completion of the test, the % change in the viscosity of the test lubricant is measured at 40° C. A lower change in the viscosity indicates better oxidation resistance of the lubricant. In general, it was noticed that aminophosphorodithioates derived from CNSL improved the oxidation resistance of oil. Likewise, the calcium sulphurized CNSL phenates also improved the oxidation stability of the lubricants. The combination of the CNSL derived alkylaminophosphorodithioates and sulfurized phenates of the present invention, gave very selective results, which were dependant upon the chemistry and length of the alkyl chain in CNSL alkylaminophosphorodithioates and percentage composition of the components in the lubricant composition. The compositions, their physico-chemical characterization and their performance in the HOOT test are presented in Tables 2 to 5.

L-38 Engine Test

The formulations of the present invention were evaluated for performance in engines having copper-lead bearings by the Labeco L-38 test method, ASTM D 5119-90. This test is designed to evaluate crankcase lubricating oils for resistance to oxidation stability, corrosion, sludge and varnish when subjected to high temperature operation. When multigrade oils are tested, it also evaluates shear stability of the test oil. The procedure involves the operation of the single cylinder CLR oil evaluation engine under constant speed, air-fuel ratio and fuel flow conditions for extended duration (commonly 80 hours), subsequent to a break-in period of 4.5 hours. Prior to each run, the engine is thoroughly cleaned, pertinent measurements of engine parts are taken, and new piston, piston rings and copper-lead connecting rod bearing inserts are installed. Bearing weight loss data is obtained at 40 hours, and at the completion of the extended test duration.

At the conclusion of the run, the engine is disassembled and the performance of the oil is judged by the following: a) a visual examination of the engine for deposits; b) by the weight loss of the copper-lead bearings; c) and by comparing the periodic oil sample analysis with the new oil analysis. The results of this test are given in Table 6. As seen from the test results, the formulation based on overbased sulfurized calcium phenates, derived from cashew nut shell liquid passed this test with bearing weight loss lower or equal than conventional sulfurized calcium phenates.

TABLE 2

Performance Evaluation of Component A and B

| S.No. | Test Sample | Panel Coker (Wt. Gain in mg) | HOOT (% viscosity increase) | DSC (increase in onset of oxidation temperature is ° C.) |
|---|---|---|---|---|
| 1. | Base Oil (BO) | 238.5 | 245 | — |
| 2. | BO + Component A (1%) | 34.3 | 82 | 28.1 |
| 3. | BO + Component A (2%) | 25.9 | 77 | 63.4 |
| 4. | BO + Commercial Phenate (1%) | 68.6 | 104 | 26.9 |

TABLE 2-continued

Performance Evaluation of Component A and B

| S.No. | Test Sample | Panel Coker (Wt. Gain in mg) | HOOT (% viscosity increase) | DSC (increase in onset of oxidation temperature is ° C.) |
|---|---|---|---|---|
| 5. | BO + Commercial Phenate (2%) | 46.7 | 99 | 59.1 |
| 6. | BO + Component B (0.5%) | 204.5 | 79 | 45.3 |
| 7. | BO + Component B (1%) | 210.9 | 71 | 87.2 |
| 8. | BO + Component A (1%) + Component B (0.5%) | 28.3 | 59 | 68.5 |
| 9. | BO + Component A (2%) + Component B (1%) | 24.7 | 45 | 102.8 |

TABLE 3

Test Lubricant Formulation Compositions

| Additive Component | Formulation I | II | III | IV | V | VI | VII |
|---|---|---|---|---|---|---|---|
| Component A | 1.0 | 2.0 | 2.0 | 2.0 | 2.0 | 3.0 | — |
| Component B | 0.5 | 0.5 | 0.8 | 1.0 | 1.0 | 0.8 | — |
| Commercial Sulfonate Detergent | 1.5 | 1.5 | 1.5 | 1.5 | 1.0 | 1.0 | — |
| ZDDP | 1.8 | 1.0 | 0.8 | 0.6 | 0.6 | 0.3 | — |
| Antioxidant (Amine/phenol) | 1.2 | 1.2 | 1.5 | 1.5 | 1.5 | 0.2 | — |
| Others containing essentially viscosity index improvers and minor amounts of metal deactivators, corrosion inhibitors and friction modifier | 26.8 | 24.8 | 24.7 | 23.9 | 8.0 | 0.5 | 17.4 |
| Commercial Engine Oil Package (SG/CD Level) | — | — | — | — | — | — | 11.6 |
| Base Oil | 67.2 | 69.0 | 68.7 | 69.5 | 85.9 | 94.2 | 71.0 |

*The formulations contained commercial VI Improver in different dosages, to impart the required viscometrics.
*Commercial dispersant, PPD & metal deactivator were added to each formulation.

TABLE 5

Performance Evaluation of Formulated Compositions

| Formulations | Panel Coker (Wt. Gain in mg) | HOOT (% viscosity increase) | DSC (increase in onset of oxidation temperature in ° C.) | Four Ball Wear Scar Dia (mm) at 40 Kg load as per ASTM D-4172 |
|---|---|---|---|---|
| I | 43.7 | 76.0 | 65.6 | 0.45 |
| II | 40.3 | 70.4 | 70.5 | 0.45 |
| III | 36.5 | 65.3 | 77.5 | 0.45 |
| IV | 30.4 | 55.6 | 80.9 | 0.40 |
| V | 31.5 | 59.8 | 82.3 | 0.40 |
| VI | 44.9 | 77.9 | 78.4 | 0.50 |
| VII | 53.0 | 88.7 | 79.5 | 0.45 |

MWM-B Test Method for Piston Cleanliness

The MWM-B test method employs the MWM KD 12 E single cylinder diesel engine for the testing, and comparative assessment of engine lubricating oils in respect to piston cleanliness. This is a swirl chamber naturally aspirated engine with a swept volume of 0.85 liters. The running-in of the test engine is carried out with the test oil. Four cycles of 0.5 hours each are run, with increasing engine speed from 1200 to 2200 l/min at a constant output of 2.5 kw, followed by five further cycles of 1 hour each at a constant engine speed of 2200 l/min, whilst increasing the output from 3.7 to approximately 11 kw.

After completion of the test, the piston is removed and the rings are inspected for sticking. In accordance with this test method, an evaluation of the piston can only be carried out with completely free piston rings. The pistons are then visually assessed as per CEC L-12-A-76 rating method. All the formulations of the present invention, based on cashew nut shell derived calcium sulfurized phenate and amino-phosphorodithioate showed rating between 66 to 70, which fall in the API CD level (See Table 6).

CLR-LTD Test for Sludge & Varnish Deposits

A CLR-LTD test is carried out to check the ability of oils to minimize the formation of undesirable deposits associated with intermittent light duty low temperature operating conditions when tested according to the prescribed procedure. Piston skirt varnish, total engine varnish, total engine sludge, oil ring plugging and oil screen clogging are measured during the test. All the formulations of the present invention, based on cashew nut shell derived calcium sul-

TABLE 4

Physico-chemical Characteristics of Lube Formulations

| Formulation | K.V. @ 100° C. | K.V @ 40° C. | VI | Pour Point ° C. | F.P (COC) | S.A | TAN | TBN | S % | Ca % |
|---|---|---|---|---|---|---|---|---|---|---|
| I | 14.79 | 109.2 | 140 | −21 | 242 | 1.73 | 2.20 | 10.0 | 1.20 | 0.26 |
| II | 13.47 | 93.39 | 145 | −24 | 240 | 1.25 | 1.89 | 12.0 | 1.15 | 0.36 |
| III | 13.40 | 92.54 | 145 | −21 | 238 | 1.32 | 1.90 | 12.3 | 1.30 | 0.36 |
| IV | 13.40 | 92.58 | 145 | −21 | 240 | 1.21 | 0.66 | 12.3 | 1.06 | 0.36 |
| V | 13.85 | 118.6 | 115 | −21 | 242 | 0.85 | 1.16 | 6.2 | 1.36 | 0.28 |
| VI | 13.56 | 132.4 | 141 | −12 | 238 | 1.56 | 1.72 | 12.8 | 0.99 | 0.44 |
| VII | 14.94 | 109.7 | 141 | −24 | 240 | 1.19 | 2.05 | 10.3 | 1.20 | 0.36 |

furized phenate and aminophosphorodithioate showed rating well above the designated pass limits of the test (See Table 6).

TABLE 6

Performance Evaluation of Lubricant Compositions, Engine Test Results

| | Name of Test | Lubricant composition V | Lubricant composition VII | Specifications |
|---|---|---|---|---|
| 1. | CRC L - 38 Engine Bearing Wt. Loss | 25.29 mg | 27.92 mg | Max. 50 mg |
| 2. | MWM - B Engine Overall Merit Rating | 69.0 | 68.0 | Min. 65 for CD<br>Min. 55 for CC |
| | CRC - LTD Test | | | |
| 3. | a) Sludge Rating | 46.58 | 46.25 | Min. 42 |
| | b) Varnish Rating | 44.49 | 43.85 | Min. 42 |
| | c) Oil Ring Slot Plugging | 0% | 2.0% | Max. 10% |
| | d) Oil Screen Clogging | 5% | 8.0% | Max. 10% |
| | e) Ring Sticking Merit | 10 | 8.5 | Min. 7.5 |

What is claimed is:

1. A lubricating oil composition for gasoline and diesel internal combustion engines, comprising:

a major portion of an oil of lubricating viscosity;

from 0.1 to 20.0% w/w of a component A which is a sulfurized, overbased calcium phenate detergent derived from distilled, hydrogenated cashew nut shell liquid; and from 0.1 to 10.0% w/w of a component B which is an amine salt of phosphorodithioic acid derived from cashew nut shell liquid and has a general formula as follows:

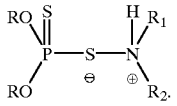

2. The lubricating oil composition according to claim 1, wherein the oil is selected from the group consisting of a mineral oil, a synthetic oil, and mixtures thereof, and has a kinematic viscosity ranging from 2 to 40 cSt at 100° C.

3. The lubricating oil composition according to claim 1, wherein component B is derived from distilled cashew nut shell liquid.

4. The lubricating oil composition according to claim 1, wherein component B is derived from distilled and hydrogenated cashew nut shell liquid.

5. The lubricating oil composition according to claim 1, wherein the amine salt of phosphorodithioic acid includes an amine moiety derived from a primary amine which is selected from at least one of a primary alkylamine and a primary alkylarylamine, and which includes an alkyl chain of from $C_1$ to $C_{20}$.

6. The lubricating oil composition according to claim 1, wherein the amine salt of phosphorodithioic acid includes an amine moiety derived from a secondary amine which is selected from at least one of a secondary alkylamine and a secondary alkylarylamine, and which includes an alkyl chain of from $C_1$ to $C_{20}$.

7. The lubricating oil composition according to claim 1, wherein the amine salt of phosphorodithioic acid includes an amine moiety derived from a tertiary amine which is selected from at least one of a tertiary alkylamine and a tertiary alkylarylamine, and which includes an alkyl chain of from $C_1$ to $C_{20}$.

8. The lubricating oil composition according to claim 1, wherein the amine salt of phosphorodithioic acid includes an amine moiety which is derived from a mixture of at least two amines selected from the group consisting of primary, secondary and tertiary amines, and which at least two amines are each selected from at least one of an alkylamine and an alkylarylamine, and each include an alkyl chain of from $C_1$ to $C_{20}$.

9. The lubricating oil composition according to claim 1, wherein component A is present in an amount ranging from 0.1 to 12.0% w/w.

10. The lubricating oil composition according to claim 1, wherein component B is present in an amount ranging from 0.1 to 6.0% w/w.

11. The lubricating oil composition according to claim 1, further comprising at least one additive.

12. The lubricating oil composition according to claim 11, wherein the at least one additive is selected from the group consisting of dispersants, antioxidants, and anti-wear substances.

* * * * *